US006895626B2

(12) United States Patent
Tsai

(10) Patent No.: US 6,895,626 B2
(45) Date of Patent: May 24, 2005

(54) RETAINING DEVICE FOR A STEAM SWAB

(76) Inventor: Sam Tsai, 4F, No. 14, Lane 281, Sec. 2, Hsi Yuan Road, Taipei (TW)

( * ) Notice: Subject to any disclaimer, the term of this patent is extended or adjusted under 35 U.S.C. 154(b) by 471 days.

(21) Appl. No.: 10/217,443

(22) Filed: Aug. 14, 2002

(65) Prior Publication Data

US 2004/0031506 A1 Feb. 19, 2004

(51) Int. Cl.[7] ..... A47L 11/03
(52) U.S. Cl. ..... 15/50.1; 15/98; 68/222
(58) Field of Search ..... 15/320, 322, 50.1, 15/98; 134/198, 102.2; 68/222

(56) References Cited

U.S. PATENT DOCUMENTS

| | | | | |
|---|---|---|---|---|
| 1,372,988 | A | 3/1921 | Wilson | 427/327 |
| 1,803,693 | A | 5/1931 | Cutting | 15/320 |
| 2,497,435 | A | 2/1950 | Branneman | 15/314 |
| 4,070,726 | A | 1/1978 | Joffre | 15/231 |
| 4,852,210 | A | 8/1989 | Krajicek | 15/228 |
| 5,876,141 | A | 3/1999 | Hsu | 401/207 |
| 5,915,437 | A | 6/1999 | Petner | 15/228 |
| 5,920,952 | A | 7/1999 | Baldacci | 15/320 |
| 6,311,365 | B1 | 11/2001 | Dornier | 15/302 |
| 6,584,990 | B2 | 7/2003 | Shaw | 134/105 |

FOREIGN PATENT DOCUMENTS

| | | |
|---|---|---|
| JP | 8-154883 | 6/1996 |
| JP | 8-322779 | 12/1996 |
| JP | 10-258008 | 9/1998 |
| JP | 11-206663 | 8/1999 |

OTHER PUBLICATIONS

WIPO WO 93/04623, Mar. 1993.

*Primary Examiner*—Frankie L. Stinson
(74) *Attorney, Agent, or Firm*—Bacon & Thomas PLLC

(57) ABSTRACT

A retaining device for a steam swab includes a first primary clamp, a second primary clamp and an auxiliary clamp. Each of the first primary clamp, the second primary clamp and the auxiliary clamp are respectively pivotal relative to the upper casing and are provided with bosses so that a fabric of the steam swab is able to be securely clamped by the first primary clamp, the second primary clamp and the auxiliary clamp.

4 Claims, 6 Drawing Sheets

RETAINING DEVICE FOR A STEAM SWAB

FIELD OF THE INVENTION

The present invention relates to a retaining device for a steam swab, and more particularly to a retaining device to secure the fabric of the steam swab so that the fabric is able to be firmly secured at all sides and an accidental falling of the fabric from the swab is avoided.

BACKGROUND OF THE INVENTION

With reference to FIG. 6, a conventional seam swab is shown and has a rod 51 for the user to hold to control the movement of the swab, a cover 52 pivotally connected to a distal end of the rod 51, two clamps 53 respectively and pivotally connected to opposite sides of the cover 52 and a fabric 54 attached to a bottom of the cover 52 to be clamped by the two clamps 53.

When this type of conventional swab is in use, it is noted that the fabric 54 is clamped by the two clamps 53 at two opposite sides. There is no support to prevent the central portion of the fabric 54 to detach from the bottom of the cover 52 such that the central portion of the fabric 54 is easily detached from the bottom of the cover 52 while two opposite sides of the fabric 54 are still clamped by the two clamps 53. Therefore, when the conventional swab in FIG. 6 is in use, the user will have to be careful of a sudden detachment of the fabric 54 from the cover 52.

To overcome the shortcomings, the present invention intends to provide an improved retaining device to mitigate or obviate the aforementioned problems.

SUMMARY OF THE INVENTION

The primary objective of the invention is to provide an improved retaining device for a steam swab so that the fabric of the steam swab is firmly secured.

Other objects, advantages and novel features of the invention will become more apparent from the following detailed description when taken in conjunction with the accompanying drawings.

DETAILED DESCRIPTION OF THE INVENTION

Figure 1:
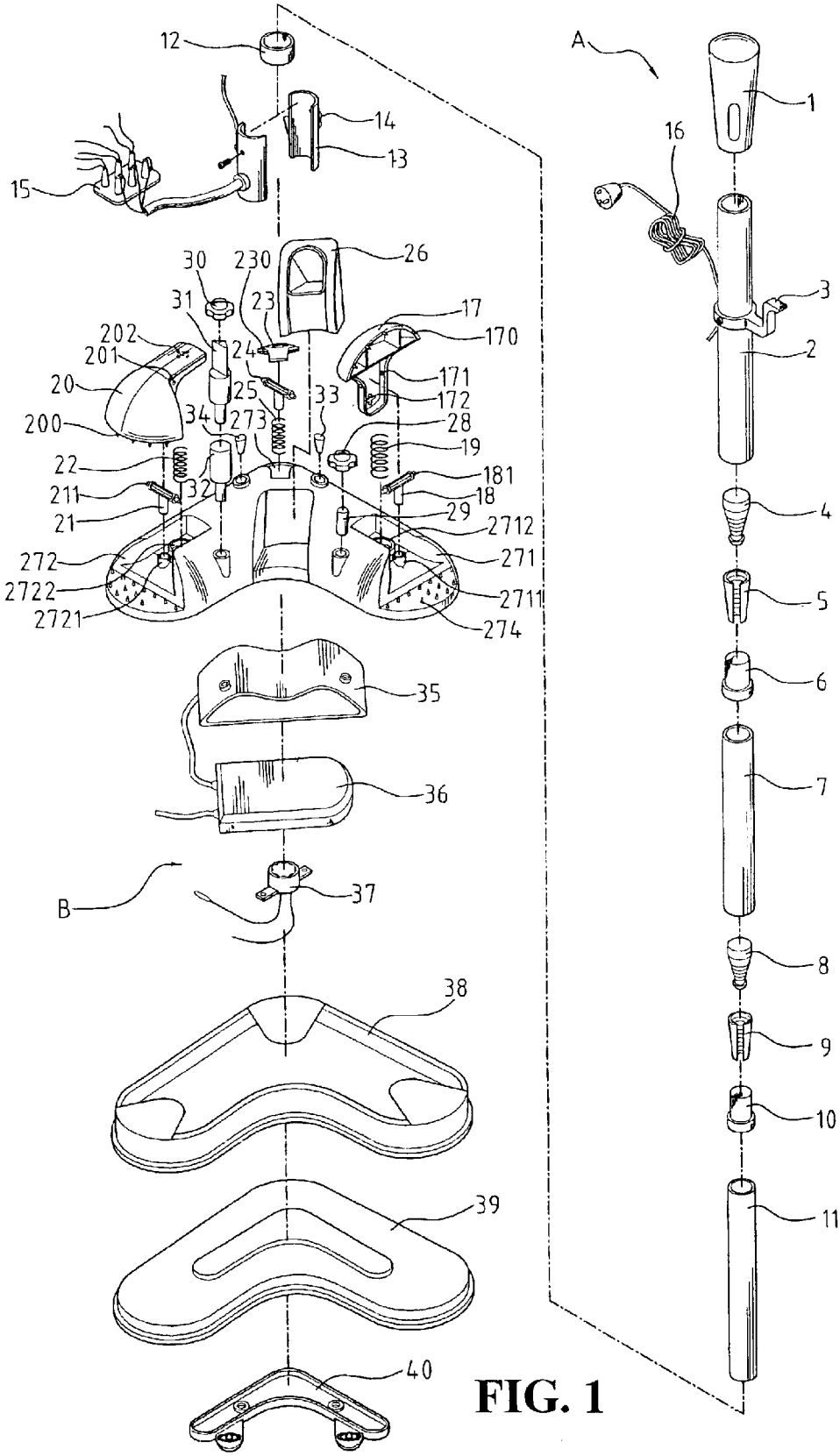
FIG. 1 is a perspective view of a steam swab with the retaining device of the present invention.
Figure 2:
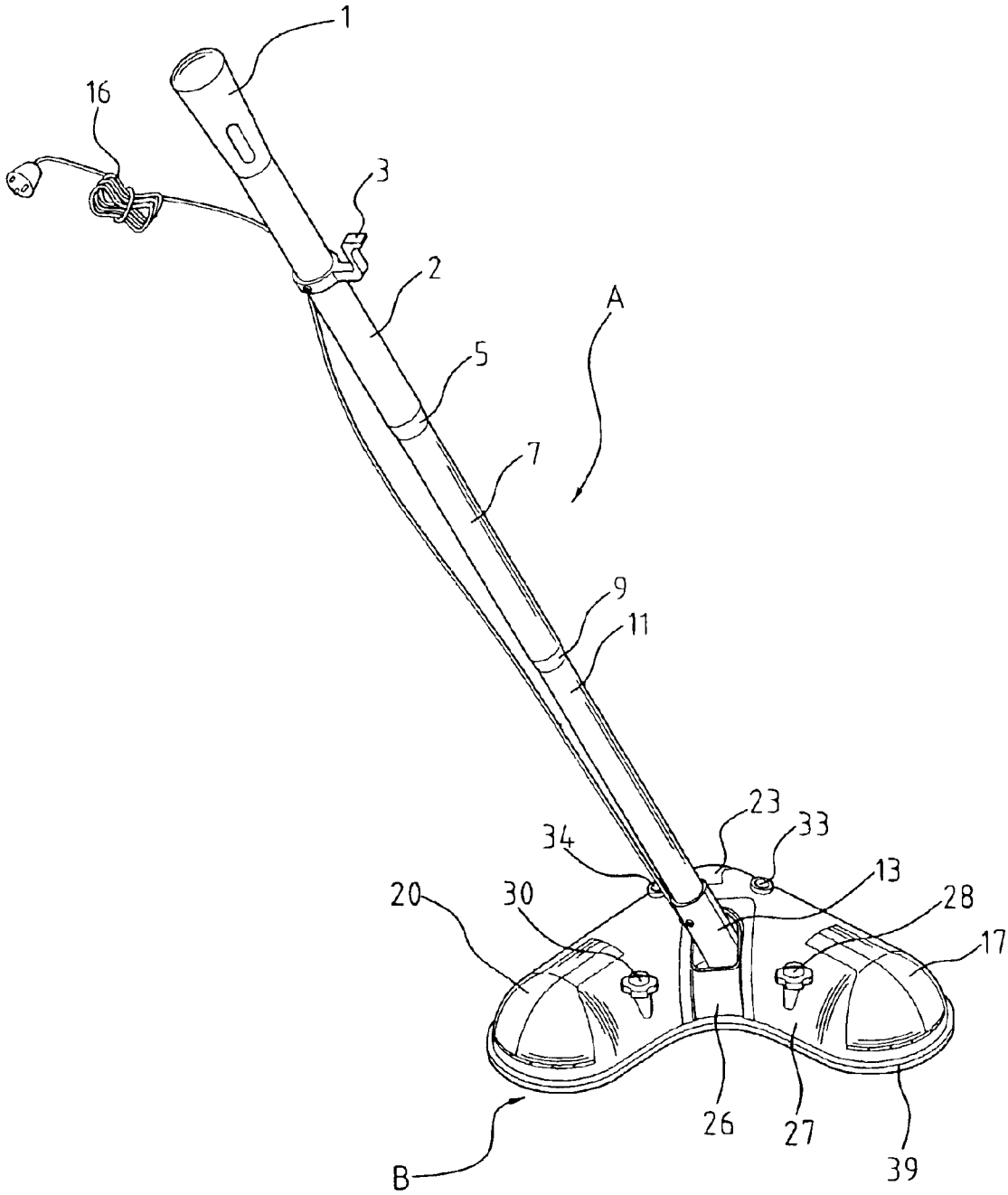
FIG. 2 is an exploded perspective view of the swab in FIG. 1.
Figure 3:
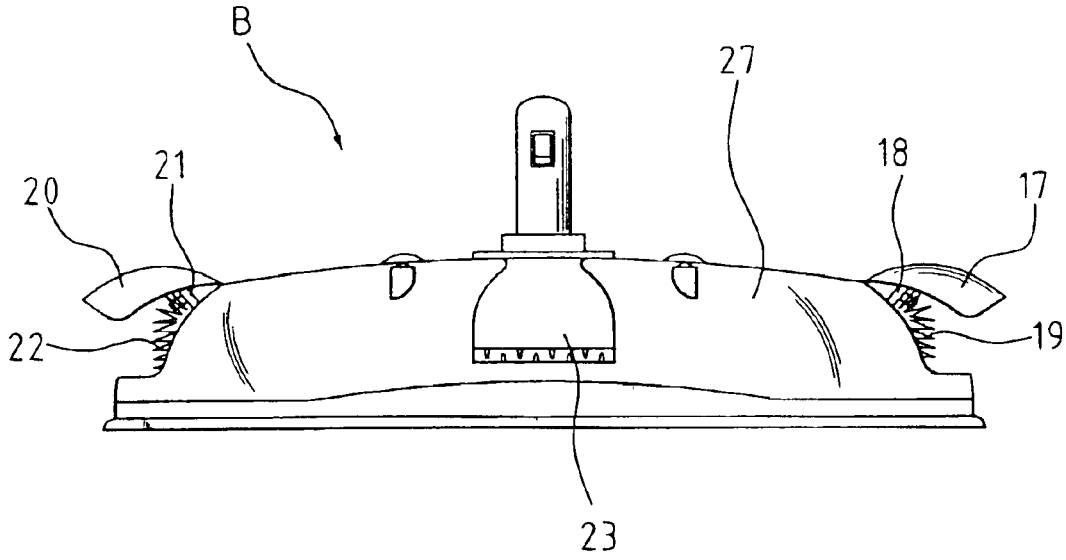
FIG. 3 is a schematic view showing the retaining device of the present invention is opened.
Figure 4:
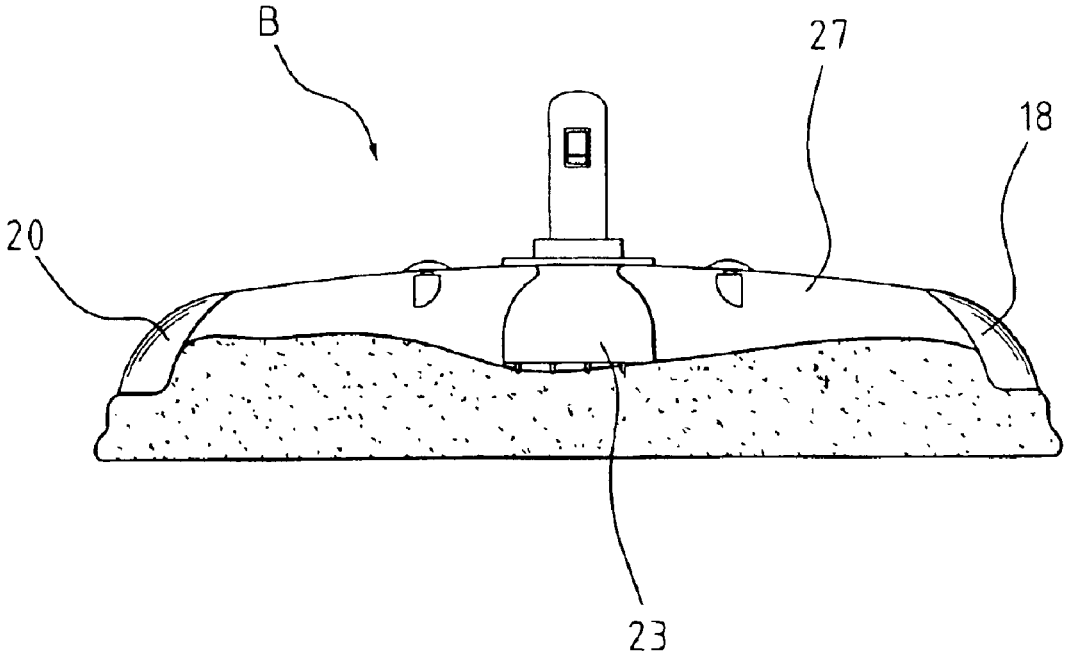
FIG. 4 is a schematic view showing the retaining device of the present invention is closed to secure the fabric.
Figure 5:
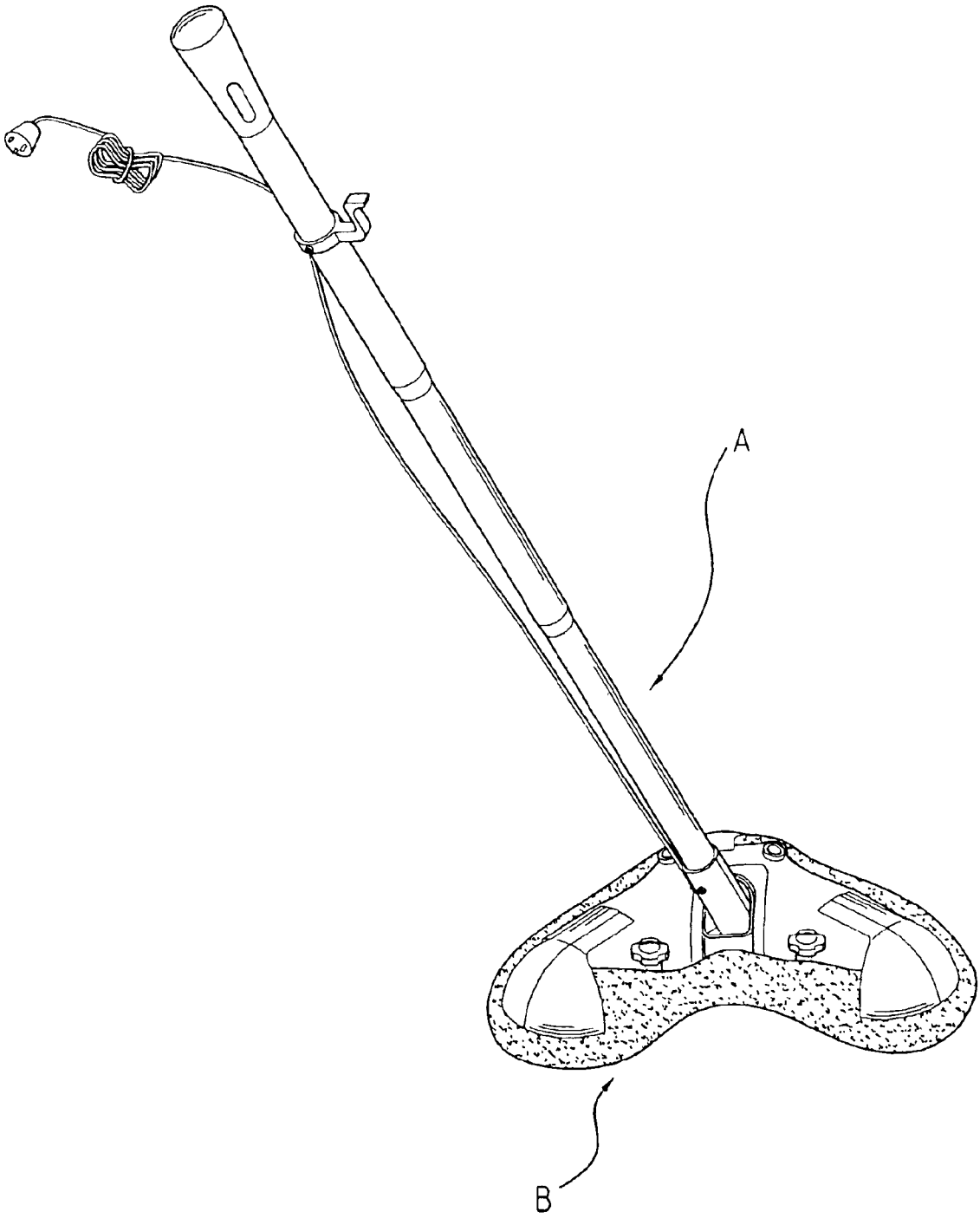
FIG. 5 is an operational view showing the steam swab is in use.
Figure 6:
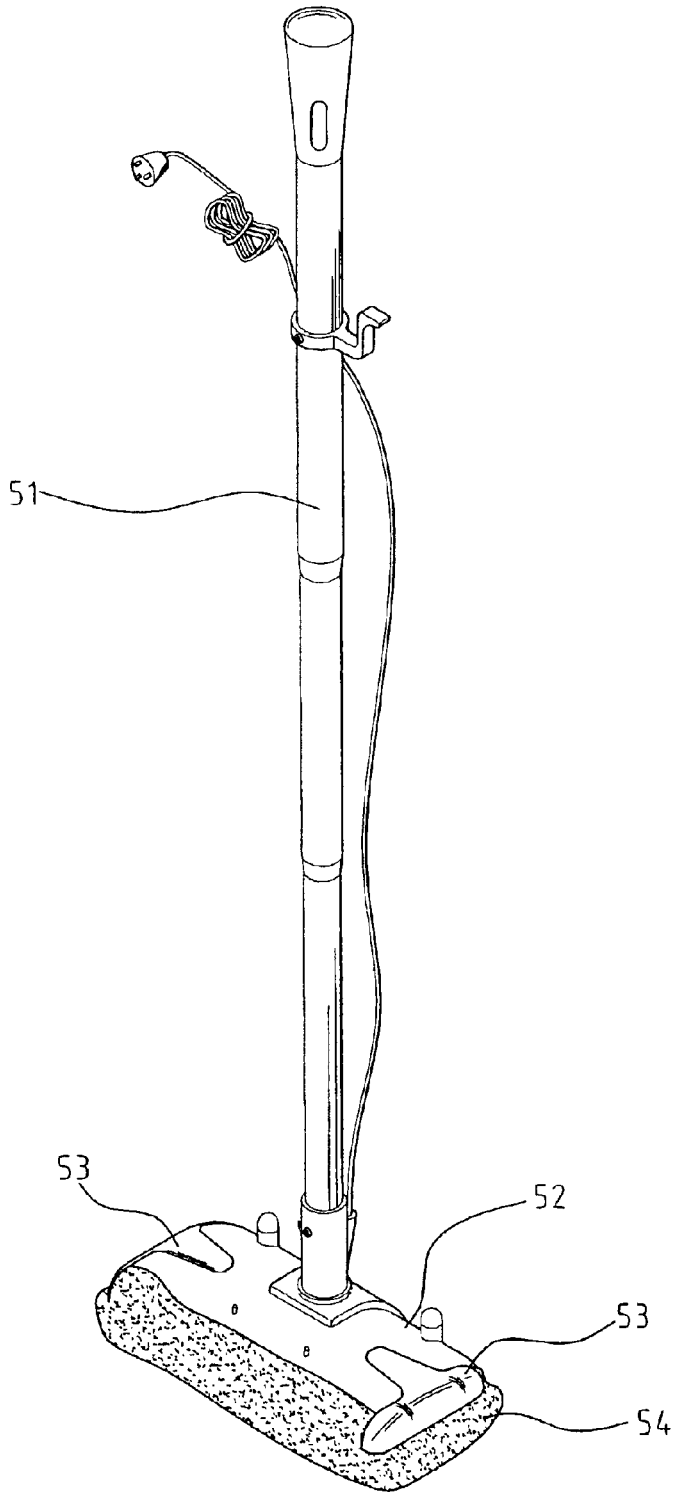
FIG. 6 (PRIOR ART)
FIG. 6 is a perspective view showing a conventional steam swab.

With reference to FIG. 1, a steam swab together with the retaining device in accordance with the present invention is shown. The seam swab includes a pole assembly A and a base assembly B.

The pole assembly A has a plastic cap 1, a first aluminum pole 2, a cable clamp 3, an upper connector 4, upper secondary connectors 5, 6, a second aluminum pole 7, a lower connector 8, lower secondary connectors 9, 10, a third aluminum pole 11, an aluminum connector 12, a holding portion 13, a power switch 14, an integrated circuit (IC) 15 and a power cable 16.

The base assembly B includes a first primary clamp 17, a first T shaped pivot 18, a first spring 19, a second primary clamp 20, a second pivot 21, a second spring 22, an auxiliary clamp 23, an auxiliary pivot 24, an auxiliary spring 25, a base 26, a triangular upper casing 27, a tank cap 28, a tank seal 29, a steam adjuster 30, a pin 31, a support 32, an indicators 33, 34, a water tank 35, a tank support 36, a temperature controller 37, a bracket 38, a triangular lower casing 39 and a ventilation base 40.

The first primary clamp 17 has two mutually aligned pivot holes 171 defined in opposite inner faces of the first primary clamp 17 to correspond to two distal ends 181 of the first pivot 18 and a guide 172 formed on a bottom face of the first primary clamp 17 to correspond to a first distal end of the first spring 19. The triangular upper casing 27 has three indentations 271,272,273 respectively defined in three distal corners of the triangular upper casing 27 and the indentation 271 has a first pivot seat 2711 formed to correspond to a distal end of the first T shaped pivot 18 and a spring seat 2712 formed to correspond to a second distal end of the first spring 19.

The second primary clamp 20 has two mutually aligned pivot holes 201 defined in opposite inner faces of the first primary clamp 20 to correspond to two distal ends 211 of the second pivot 21 and a guide 202 formed on a bottom face of the second primary clamp 20 to correspond to a first distal end of the second spring 22. The indentation 272 has a second pivot seat 2721 formed to correspond to a distal end of the second T shaped pivot 21 and a spring seat 2722 formed to correspond to a second distal end of the second spring 22.

The relationship of auxiliary clamp 23, the auxiliary pivot 24, the auxiliary spring 25 and the indentation 273 is the same as those described in the first primary clamp 17 and the second primary clamp 20.

The assembly of the plastic cap 1, the first aluminum pole 2, the cable clamp 3, the upper connector 4, upper secondary connectors 5, 6, the second aluminum pole 7, the lower connector 8, lower secondary connectors 9, 10, the third aluminum pole 11, the aluminum connector 12, the holding portion 13, the power switch 14, the integrated circuit (IC) 15 and the power cable 16 is conventional in the art, detailed description thereof is thus omitted.

When the first primary clamp 17 is in assembly with the triangular upper casing 27, the two distal ends 181 of the first pivot 18 are inserted into the respective pivot holes 171 and a distal end of the first pivot 18 is detachably received in the first pivot seat 2711. Then, the two distal ends of the first spring 19 are respectively connected to the guide 172 and the spring seat 2712.

With reference to FIGS. 2, 3, 4 and 5, when the second primary clamp 20 is in assembly with the triangular upper casing 27, the two distal ends 211 of the second pivot 21 are inserted into the respective pivot holes 201 and a distal end of the second pivot 21 is detachably received in the second pivot seat 2721. Then the two distal ends of the second spring 22 are respectively connected to the guide 202 and the spring seat 2722. Accordingly, the auxiliary clamp 23 has the same relationship with the triangular upper casing 27. Therefore, after the first primary clamp 17, the second primary clamp 20 and the auxiliary clamp 23 are respectively connected to the triangular upper casing 27, the first primary clamp 17, the second primary clamp 20 and the auxiliary clamp 23 are able to pivot relative to the triangular upper casing 27. Furthermore, first bosses 274 are formed on a bottom face defining the indentation 271,272,273 to correspond to second bosses 170,200,230 respectively formed on a peripheral edge of the first primary clamp 17, the second primary clamp 20 and the auxiliary clamp 23.

With the arrangement as such described, a fabricate 54 (the same as that described in the conventional swab) is able to be clamped by three different points, the first primary clamp 17, the second primary clamp 20 and the auxiliary clamp 23 so that the user will no longer have to worry about the fabric 54 might be loosened during the cleaning process. Further, because the upper casing 27 as well as the bracket 38, the lower casing 39 and the ventilation base 40 are all triangular, the user is able to use the steam swab to extend into and clean corners of the wall and small spaces in the room.

What is claimed is:

1. A retaining device for a steam swab having a pole assembly and a base assembly, the retaining device comprising:

a first primary clamp having two mutually aligned pivot holes defined in opposite inner faces of the first primary clamp to correspond to two distal ends of a first T shaped pivot and a guide formed on a bottom face of the first primary clamp to correspond to a first distal end of a first spring;

a triangular upper casing having a first, a second and a third indentation respectively defined in three distal corners of the triangular upper casing, wherein the first indentation has a first pivot seat formed to correspond to a distal end of the first T shaped pivot and a spring seat formed to correspond to a second distal end of the first spring;

a second primary clamp having two mutually aligned pivot holes defined in opposite inner faces of the second primary clamp to correspond to two distal ends of a second T shaped pivot and a guide formed on a bottom face of the second primary clamp to correspond to a first distal end of a second spring, wherein the second indentation has a second pivot seat formed to correspond to a distal end of the second T shaped pivot and a spring seat formed to correspond to a second distal end of the second spring; and an auxiliary clamp having two mutually aligned pivot holes defined in opposite inner faces of the auxiliary clamp to correspond to two distal ends of a third T shaped pivot and a guide formed on a bottom face of the auxiliary clamp to correspond to a first distal end of a third spring, wherein the third indentation has a third pivot seat formed to correspond to a distal end of the third T shaped pivot and a spring seat formed to correspond to a second distal end of the third spring, whereby the first primary clamp, the second primary clamp and the auxiliary clamp are able to pivot relative to the upper casing and are adapted to securely clamp a fabric of the steam swab.

2. The retaining device as claimed in claim 1, wherein the upper casing is triangular so that the steam swab is able to extend into compact space.

3. The retaining device as claimed in claim 2, wherein the first primary clamp, the second primary clamp and the auxiliary clamp are respectively provided with first bosses correspond to second bosses formed on the first, the second and the third indentation so that the fabric is sandwiched between the first and the second bosses.

4. The retaining device as claimed in claim 1, wherein the first primary clamp, the second primary clamp and the auxiliary clamp are respectively provided with first bosses correspond to second bosses formed on the first, the second and the third indentation so that the fabric is sandwiched between the first and the second bosses.

* * * * *